US005953952A

United States Patent [19]

Strickland

[11] Patent Number: 5,953,952

[45] Date of Patent: Sep. 21, 1999

[54] MICRO-ADJUSTABLE BUCKING BAR ANVIL

[76] Inventor: Frederick Wayne Strickland, 1520 Blueberry Dr., Titusville, Fla. 32780

[21] Appl. No.: 09/256,715

[22] Filed: Feb. 22, 1999

[51] Int. Cl.[6] ..... B21J 15/40

[52] U.S. Cl. ..... 72/466.9; 72/480; 29/243.53

[58] Field of Search ..... 72/479, 480, 466.9; 29/243.53, 243.517

[56] References Cited

U.S. PATENT DOCUMENTS

| | | | |
|---|---|---|---|
| 1,410,696 | 3/1922 | Malzi | 29/243.53 |
| 1,821,410 | 9/1931 | Taylor | 29/243.53 |
| 2,353,559 | 7/1944 | Hajek, Jr. | 78/53.5 |
| 2,354,914 | 8/1944 | Goldstein | 78/53.5 |
| 2,513,780 | 7/1950 | Baxter | 29/243.53 |
| 2,630,030 | 3/1953 | Gann | 78/46 |
| 3,478,567 | 11/1969 | Galutia | 72/457 |
| 3,557,442 | 1/1971 | Speller | 29/243.53 |
| 3,561,102 | 2/1971 | Diemer | 29/509 |
| 3,562,893 | 2/1971 | Winslow | 29/243.53 |
| 3,585,838 | 6/1971 | Newlon | 72/465 |
| 3,828,421 | 8/1974 | Erlichman | 29/522 |
| 3,952,401 | 4/1976 | Wagner | 29/243.53 |
| 4,019,238 | 4/1977 | Fuhrmeister | 29/243.53 |
| 4,133,096 | 1/1979 | Falcioni | 29/243.53 |
| 4,218,911 | 8/1980 | Johnston | 72/479 |
| 4,398,411 | 8/1983 | Emmerich | 72/482 |
| 4,649,733 | 3/1987 | Gilmore | 72/479 |
| 5,189,780 | 3/1993 | Landes | 29/243.53 |
| 5,269,381 | 12/1993 | Oscarsson | 173/162.2 |
| 5,333,980 | 8/1994 | Pratt | 411/501 |
| 5,361,473 | 11/1994 | Landes | 29/243.53 |
| 5,572,900 | 11/1996 | Ayeni | 72/453.19 |
| 5,588,323 | 12/1996 | Peterson | 72/465 |

*Primary Examiner*—David Jones

[57] ABSTRACT

Disclosed is a hand held micro-adjustable bucking bar anvil having an adjustable threaded spindle for positioning the anvil face to the correct height above the surface of the sheet metal, for shaping new rivet heads to the proper diameter, height, and shape meeting the manufacturer's specifications for riveting sheets of metal together as the riveting process is completed. A further disclosure of this present invention is incorporating a threaded spindle having positioning feet. The positioning feet will maintain the rivet head tolerances as the self-leveling feet reaches the working surface; the feet will align the micro-adjustable bucking bar's horizontal and vertical axis to meet the height, diameter, and shape of the rivet heads. The feet align the bucking bar anvil equally on flat surfaces as well as curved surfaces, while shaping rivet heads. The hand held micro-adjustable bucking bar anvil incorporates a spring-loaded spindle lock for locking the threaded spindle in a desired position on the micro-adjustable bucking bar. This creates a micro-adjustable spindle for easy setting by an inexperienced or experienced bucking bar operator while maintaining the rivet head tolerances to the manufacturing specification.

14 Claims, 10 Drawing Sheets

MICRO-ADJUSTABLE BUCKING BAR ANVIL

FIELD OF THE INVENTION

The present invention is directed at improvements in hand held bucking bar anvils used in precision forming of rivet shanks into rivet heads, which must meet military and manufacturing specifications for rivet installation.

BACKGROUND OF THE INVENTION

Riveting bucking bar anvils that are designed to be hand held by bucking bar operators must maintain an alignment on the rivet shank by sight, feel and balance. This often leaves the bucking bar operator a wide margin for errors when the bucking bar is out of alignment with the rivet shank. The traditional method for joining two or more overlapping sheets of metal together is installing rivets through numerous pre-drilled holes in the metal sheets. By positioning a rivet gun anvil to the manufactured rivet heads and referring to the second end of the rivet, a hand held rivet bucking bar anvil is positioned by a bucking bar operator on the flat diameter surface of the rivet shank protruding through a pre-drilled hole in the metal sheets. By means of a rapid burst of hammering effects from the rivet gun, energy is transferred to the head of the rivet, through the shank and onto the flat surface of the hand held bucking bar anvil.

The energy returning from the hand held bucking bar anvil to the face of the rivet shank would help shape the shank's diameter. This shaping of the shank's diameter enlarges as the energy stemming from the rivet gun and the bucking bar operator's pressure is directed toward the head of the manufactured rivet. Combining the energy and pressure shapes the new rivet head. This fastens the two or more overlapping metal sheets together with a manufactured rivet head on one end and a shop formed rivet head on the second end.

This manually controlled shaping of the rivet shank into a specific shape and size rivet head is generally guesswork and technique. An apprentice learns the guesswork and technique by applying enough pressure and trying to maintain alignment of the anvils' face at a ninety degree angle to the work surface in order to shape a new rivet head. This method of operation makes it nearly impossible to have all newly formed rivet heads conform exactly to the manufacturing specifications by manually maintaining the hand held alignment. Many newly formed rivet heads made by apprentices do not meet the manufacturing specifications and must be removed by drilling into the center of the manufactured rivet head and separating the rivet head from the shank. The shank with the (out of tolerance) rivet head is then removed from the overlapping metal sheets and a new rivet must be installed and a new head formed. This process adds cost and time to the parts being manufactured.

CROSS-REFERENCE TO RELATED APPLICATIONS

However, some sophisticated head forming apparatus are available, such as that illustrated in U.S. Pat. No. 2,353,559 to Hajek (1942), U.S. Pat. No. 2,354,914 to Max Goldstin (1994), U.S. Pat. No. 4,218,911 to Johnston (1980), U.S. Pat. No. 4,649,733 to Gilmore (1987), U.S. Pat. No. 5,269,381 to Oscarsson (1993), U.S. Pat. No. 5,588,323 to Peterson (1996) and U.S. Pat. No. 5,572,900 to Ayeni (1996). These devices do not have a self-aligning feet, rivet shank guide, a removable anvil tip, removable weighted handle, quick release lock or a micro-adjustable spindle to vary the height of new rivet heads.

Additional disadvantages are the undesirable friction and damage caused by the rapped movement of the housings along the axis of the tool. When the anvil surface is out-of-tolerance or damaged the complete tool or a major portion of the tool will be replaced.

BRIEF SUMMARY OF THE INVENTION

Accordingly, one objective of the present invention is to provide a hand held micro-adjustable bucking bar anvil having an adjustable threaded spindle for positioning the anvil tip to the correct height above the surface of the sheet metal.

A second objective is to shape a shop made rivet's head to the proper diameter, height and shape to meet the manufacturer's specifications for riveting sheets of metal together.

A third objective is to incorporate a threaded spindle having positioning feet to maintain the rivet head tolerances on flat working surfaces as well as curved working surfaces, while shaping rivet heads. These positioning feet will maintain the rivet head tolerances to the manufacturing specification.

A further objective of the present invention is to incorporate a compression spring into the positioning feet cavity to press the sheet metal together, eliminating any space between the sheets.

A related objective is to provide a hand held bucking bar anvil incorporating a spring-loaded spindle lock, which will lock the threaded spindle to a desired position on the bucking bar's anvil. This will in turn make the micro-adjustable spindle easy to set by either an inexperienced or experienced bucking bar operator.

Another objective is to provide a hand held micro-adjustable bucking bar having a recess in the end of the bucking bar to receive or remove anvil tips of various sizes, or replace a worn out anvil tip, without replacing the entire threaded bucking bar.

Still another objective of this invention is to provide a hand held micro-adjustable bucking bar anvil that removes all guesswork and techniques from the bucking bar operator and replaces the old techniques with a micro-adjustable bucking bar anvil. Both inexperienced and experienced operators will make the transition very quickly in forming certified rivet heads with a minimal amount of training.

One last objective is to provide a handle weight to which the micro-adjustable bucking bar anvil is attached. This will combine numerous rectangular anvil designs into one handle, accommodating the smallest to largest rivet size bucking bar and bucking bar weight requirements.

Additional objectives and advantages of the present invention are set forth in part by the description that follows, and in part it will be obvious from the implementation and direct use of this invention. The objectives and advantages may be realized and attained by means of the instrumental and combinations particularly specified in the appended claims.

To achieve the following, and other objectives and advantages, and in accordance with the purposes of the present invention as embodied and broadly described herein: a hand held micro-adjustable bucking bar constructed in accordance with the present invention may be comprised of a cylindrical housing supporting a threaded end cap, double threaded bucking bar, anvil tip, spring, compressible spindle lock, spindle, spindle spring, spindle feet and a centering grommet.

In operation, the micro-adjustable bucking bar will be attached to a suitable weighted handle after determining the correct size rivets to be used. The operator will set the micro-adjustable spindle by choosing the proper rivet head template ("template" refers to an assortment of correctly mounted shop formed rivet heads on a metal plate meeting the manufacturing installation specifications) and adjusting the micro-adjustable spindle by compressing the spindle locking collar toward the cylindrical housing, separating the castellated locks, allowing the micro-adjustable spindle to rotate.

Rotating the micro-adjustable spindle clockwise will shorten the distance of the anvil tip to the working surface; rotating it counterclockwise will extend the anvil tip away from the working surface. Rotating the micro-adjustable spindle in the correct direction will position the feet down onto the surface of the sheet metal, while the anvil's tip is mated to the top surface of the rivet head. This will set the distance from the sheet metal's surface to the anvil tip, which in turn sets the anvil tip and positions the feet to meet the requirements for forming certified rivet heads during the riveting process.

Once the micro-adjustable bucking bar anvil tip measurements have been set, the operator will release the spindle locking collar allowing the spindle spring to push the spindle lock toward the castellated locks, locking the micro-adjustable spindle in place. At this point, the operator will start bucking rivets by placing the hand held micro-adjustable bucking bar's compression spring against the sheet metal's surface and applying a small amount of pressure to remove any air gap between the sheets. The bucking bar operator will then further lower the anvil's tip against the protruding diameter end of the rivet shank. Applying sufficient pressure simultaneously as the riveter starts operating the riveting gun will force the shank's diameter to rapidly expand as the hand held bucking bar and anvil tip are pushed toward the surface of the sheet metal. As the micro-adjustable spindle positioning feet move firmly against the sheet metal, it will automatically make the final alignments as the expansion of the rivet's head diameter approaches D=1.5d (D being the rivet diameter) which is the limit above which cracks form in the rivet's head. The spindle positioning feet stop all movement of the hand held micro-adjustable bucking bar anvil, preventing further shaping of the rivet head during the final riveting process, which meets the manufacturing specification for forming production rivets heads.

The accompanying drawings that are incorporated in and constitute a part of this specification illustrate the embodiments of the present invention; together with the description, they serve to explain the principles of the invention. Like numerals are employed to designate like parts throughout.

DETAILED DESCRIPTION OF THE INVENTION

Figure 1:
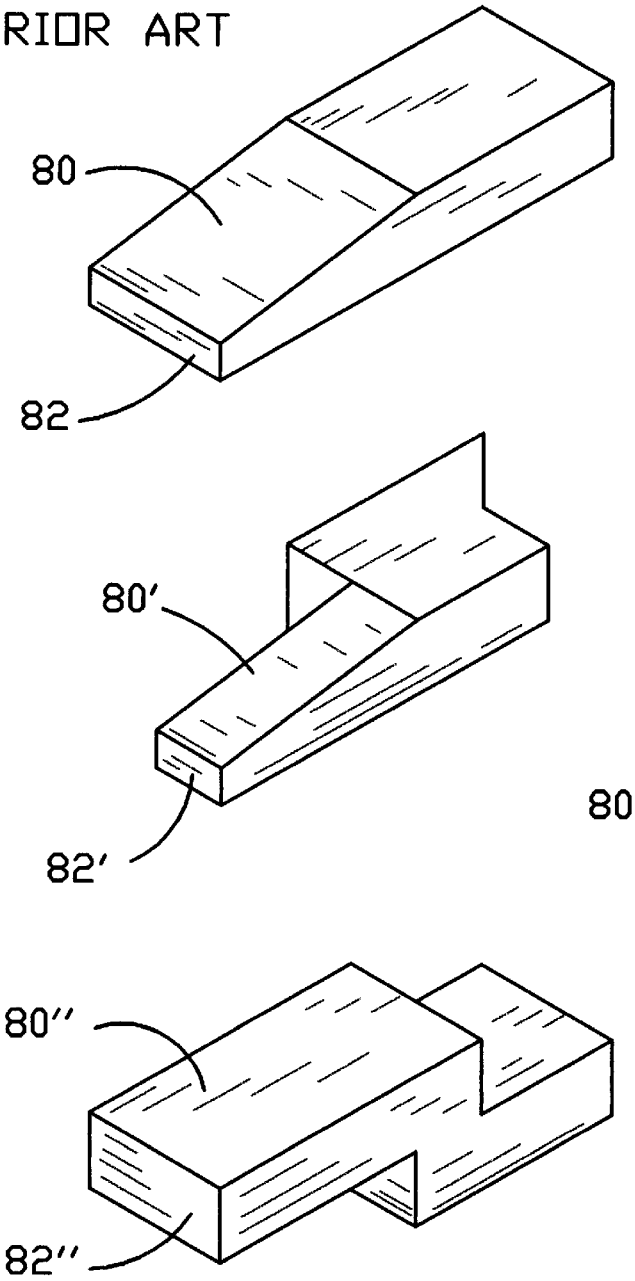
FIG. 1 PRIOR ART
FIG. 1 Is a perspective view of prior art hand held rivet bucking bar anvils.
Figure 1A:
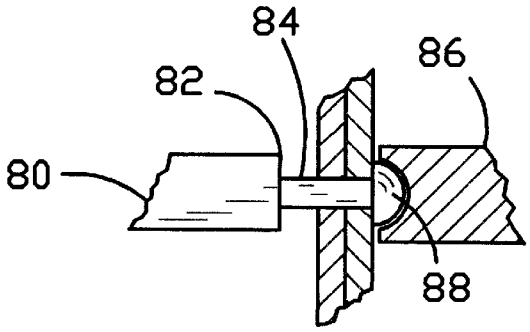
FIG. 1*a* Is a perspective view of prior art hand held rivet bucking bar starting position.

Referring with greater particularity to the drawing, the reference numeral 10 indicates generally a micro-adjustable bucking bar anvil, embodying the principles of the invention. FIG. 1 provides examples of prior art riveting anvils 80 having solid casings of various sizes, shapes and weights that are used for bucking rivet shanks and forming rivet heads. Placing the hand held anvil's 80 flat surface 82 against the protruding shank 84 of the rivet and using a rivet gun 86 against the manufactured rivet head 88 and simultaneously pressing the anvil 80 toward the manufactured rivet head 84 will allow the contouring of the shank 84 into the second rivet head. This process accomplishes a permanent installation of the rivet holding two or more sheets of metal together.

Figure 2:
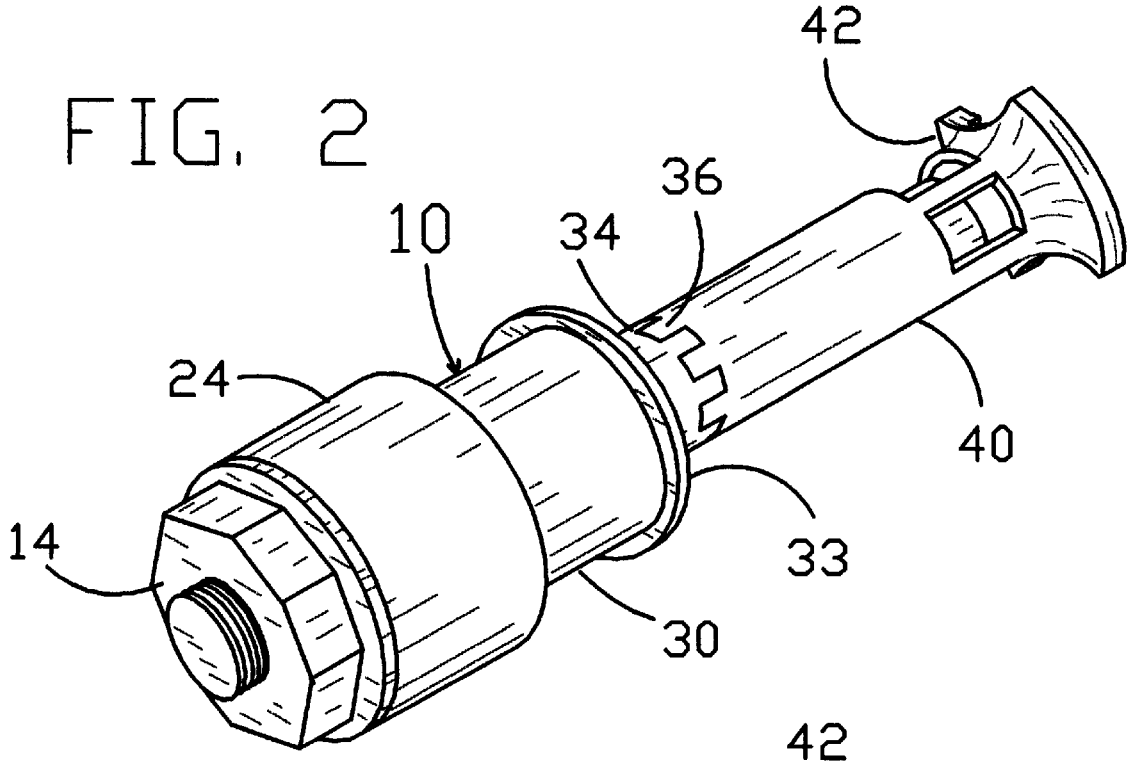
FIG. 2 Is a perspective view of the hand held micro-adjustable bucking bar assembly in the locked positions.
Figure 2A:
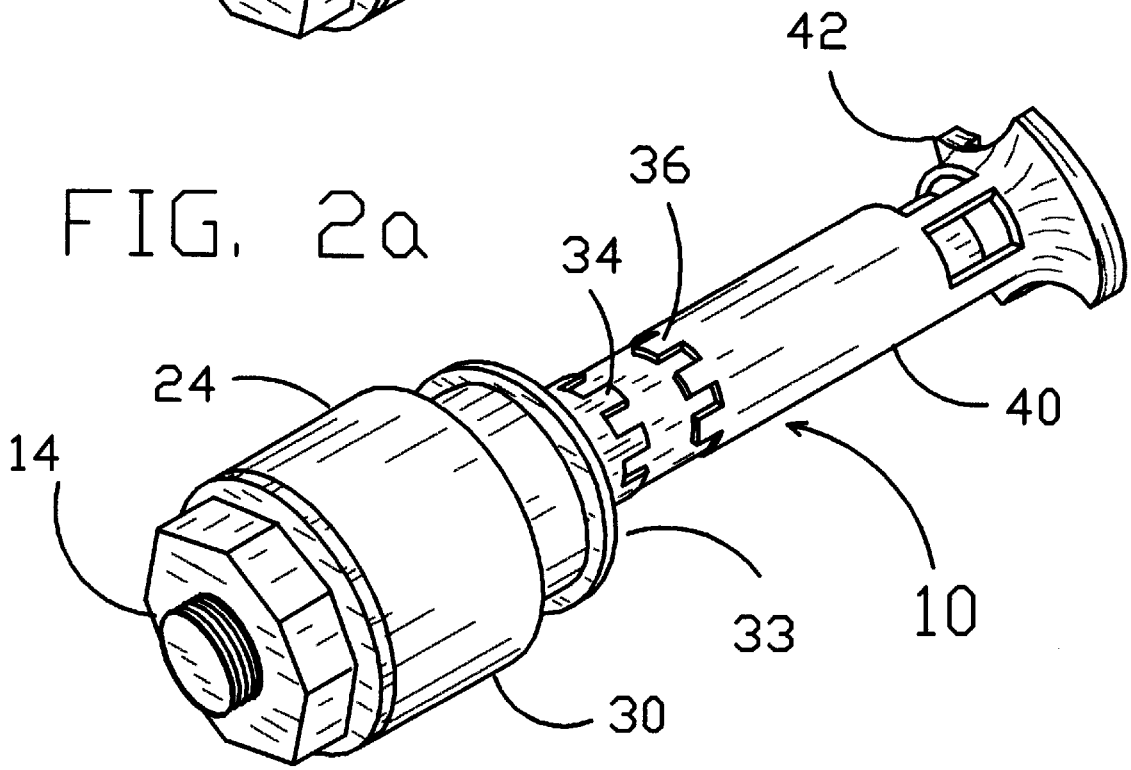
FIG. 2*a* Is a perspective view of the hand held micro-adjustable bucking bar assembly in the unlocked positions.

FIG. 2 illustrates a locked micro-adjustable bucking bar anvil 10 in an intermediate position, and FIG. 2*a* illustrates an unlocked micro-adjustable bucking bar anvil 10 having a end cap 14 fastened to a cylindrical housing 24 and supporting a spindle lock 30. The narrow end of the spindle lock 30 supports a spindle lock collar 33 and on the extreme end a castellated lock 34. A micro-adjustable spindle 40 has on the first end a castellated lock 36 and on the second end a set of spindle positioning feet 42.

Figure 3:
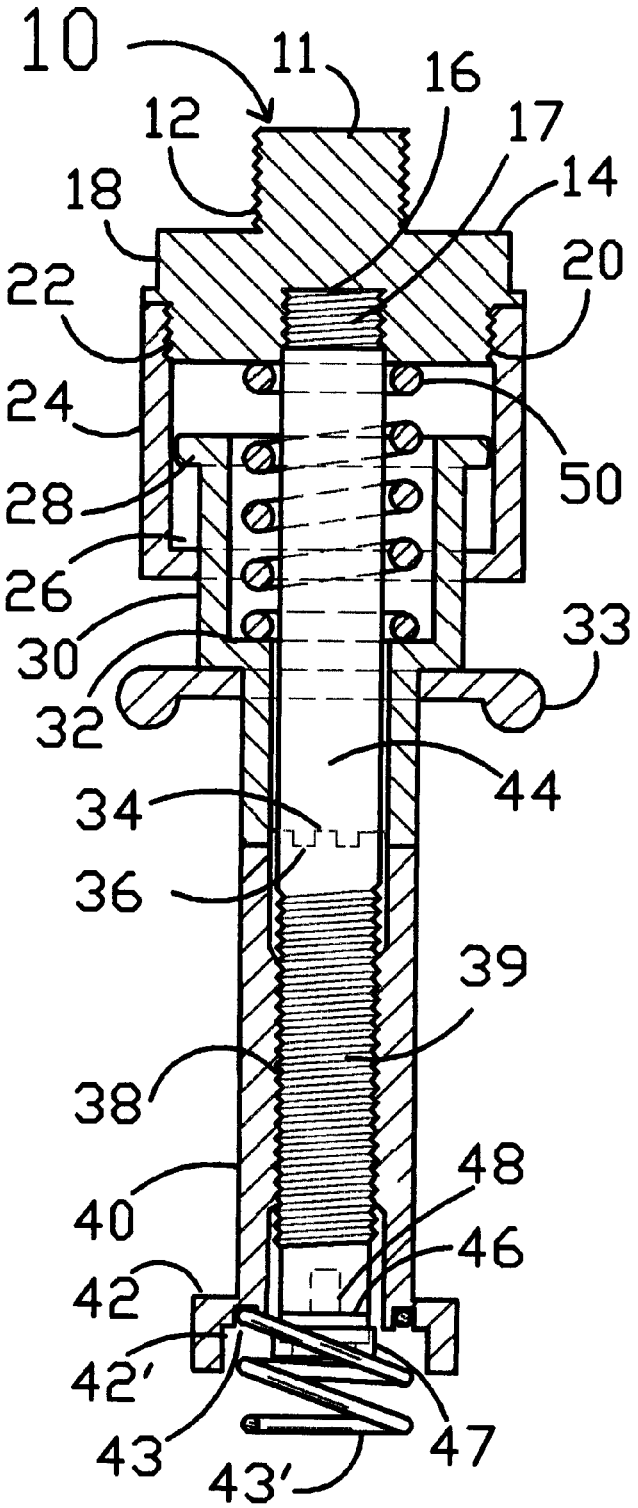
FIG. 3 Is a sectional view showing the assembled hand held micro-adjustable bucking bar.

FIG. 3 shows a micro-adjustable bucking bar anvil 10 having an end cap 14 with a set of external threads 20 and a wrench flange 18. Cylindrical housing 24 has a set of internal threads 22 on the first end and a cylindrical flange 26 on the second end. The cylindrical flange 26 supports a cylindrical spindle-locking flange 28 thereby supporting the spindle lock 30. The narrow end of the spindle lock 30 supports the spindle lock collar 33. A spindle lock flange 32 supports a spring 50 and presses against the end cap 14 and the spindle-locking flange 32. The micro-adjustable spindle 40 has a set of internal threads 38 that are threaded onto a set of long external threads 39 on a bucking bar 44 and is positioned for locking into a set of micro-adjustable spindle's castellated locks 34 and 36. The spindle feet 42 define the second end of the spindle 40. Inside the second end of the spindle 40 is a spindle cavity 42', a compression spring retaining groove 43 and compression spring 43'. The bucking bar 44 has a set of short threads 17 that are threaded into a threaded cavity 16 in the end cap 14. At the second end of the bucking bar 44 is a cavity 48 housing a anvil tip 46. The hand held micro-adjustable bucking bar anvil 10 will be installed onto a weighted handle 90 by threading onto a end cap's shaft 11 having a set of external threads 12, into one of the handle recesses 91, (best seen in FIG. 9).

Figure 4:
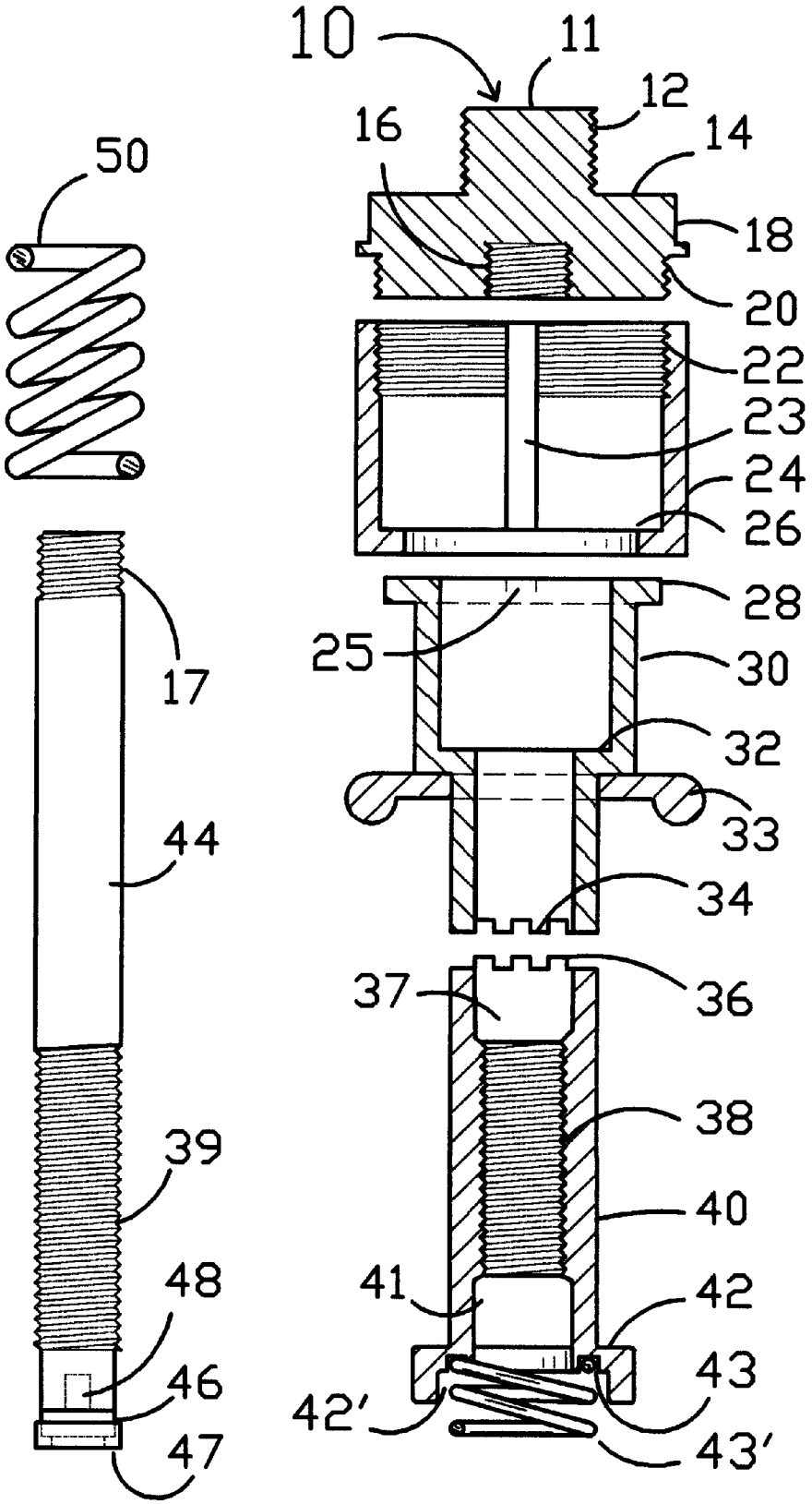
FIG. 4 Is an exploded view showing the individual parts of the hand held micro-adjustable bucking bar.

FIG. 4 presents a view of the coiled spring 50 and the bucking bar 44 with short threads 17 on the first end and long threads 39 on the second end. The anvil tip 46 is shown installed in the bucking bar cavity 48, and a rubberized self-centering boot 47 is installed onto the bucking bar's second end 44. The end cap 14 shows the external threads 12 on stud 11 and external threads 20 and end cap wrench flange 18. The internal threads 16 will receive a set of the bucking bar's 44 short threads 17. The cylindrical housing 24 has a set of internal threads 22 in the first large diameter end and a internal cylindrical flange 26 in the second end. Inside the cylindrical housing 24 a flute 23 extends from the first end of the large diameter toward the internal cylindrical flange 26. The spindle lock 30 has a external flange 28 incorporating a tang 25. The spindle lock 30 forms in part the first and second cylindrical shapes, having a internal flange 32. A spindle-locking collar 33 is positioned on the smaller circumference of the spindle lock 30 and a castellated arrangement 34 forms the second end of the spindle lock 30. The micro-adjustable spindle 40 has on the first end a castellated lock 36 of the same diameter as the smaller end of the spindle lock's 30 castellated lock 34. The micro-adjustable spindle 40 has a first cavity 37 incorporating a set of internal national fine standards threads 38 and a second cavity 41 giving clearance for the anvil tip 46. The positioning feet 42 shapes the ends of the micro-adjustable spindle 40, incorporate the compression spring retainer groove 43 inside the spindle cavity 42' and support the compression spring 43'.

Figure 5:
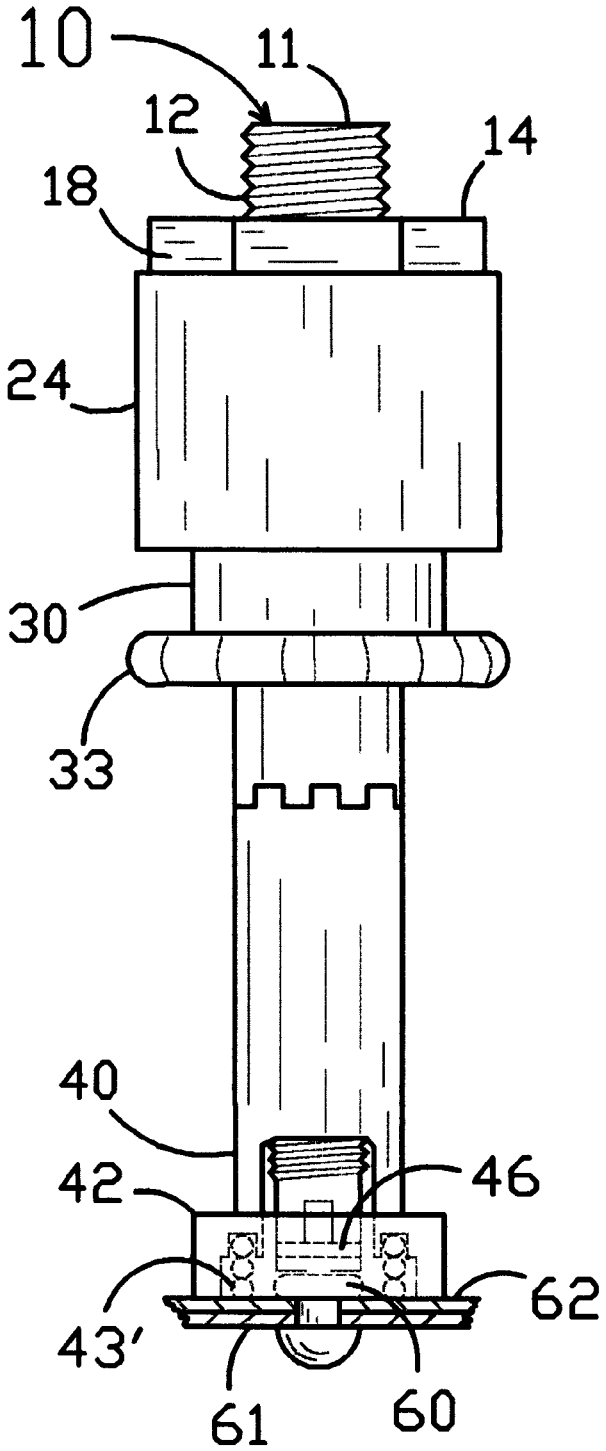
FIG. 5 Is a perspective view showing the assembled hand held micro-adjustable bucking bar anvil and an example of a rivet head template.

FIG. 5 shows an elevated view of the micro-adjustable bucking bar anvil 10. Using a standard rivet head template 61 the operator will adjust the micro-adjustable spindle 40 to set the proper height of the anvil tip 46. The operator will place the anvil tip 46 against the top surface of the standard rivet template's 61 rivet head 60, and by adjusting the micro-adjustable spindle 40 and moving the spindle feet 42 compressing the compression spring 43' down onto the sheet metal's surface 62 it will set the height of a newly formed rivet head.

Figure 6:
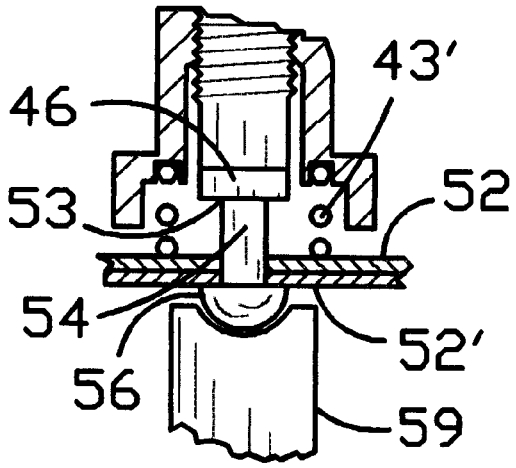
FIG. 6 Is a sectional view showing the proper position to start shaping shop formed rivet heads.

FIG. 6 demonstrates the beginning process of shaping a rivet head 54. Placing the compression spring 43' against a sheet metal's surface 52 and applying a small amount of pressure will squeeze out any air gaps between the overlapping metals sheets 52 and 52'. Additionally the anvil tip 46 presses against the rivet shank's 54 flat surface 53 in the starting position.

Figure 6A:
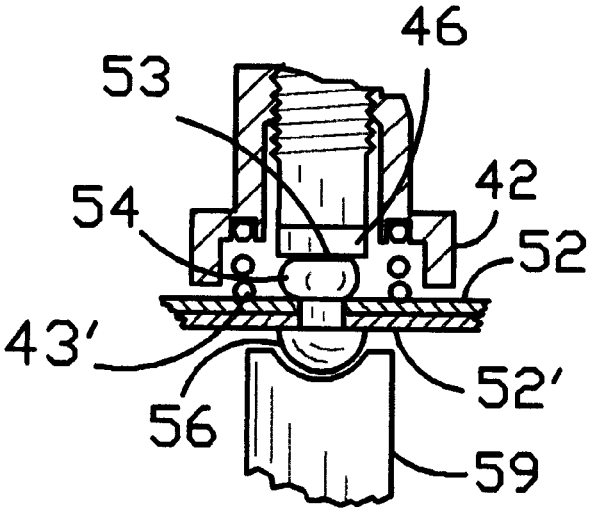
FIG. 6*a* Is a sectional view showing the rivets shank diameter enlarging to form a rivet head.

FIG. 6*a* shows rivet 56 and the shank's 54 diameter enlarging as the anvil tip 46 and spindle feet 42 move toward the metal surface 52 while compressing spring 43' as the riveter operates the riveting gun 59.

Figure 6B:
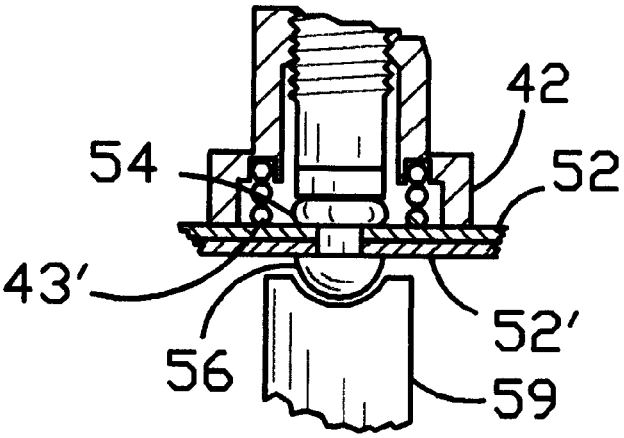
FIG. 6*b* Is a sectional view showing the final alignment of the spindle feet.

FIG. 6*b* completes the process of forming the rivet's head 54 as the feet 42 align the hand held micro-adjustable riveting bucking bar 10 when it bottoms out against the sheet metal's surface 52.

Figure 6C:
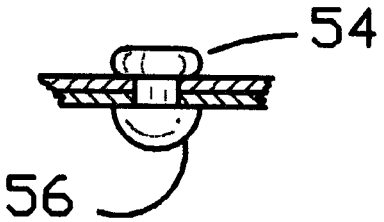
FIG. 6*c* Is a perspective view showing the completed shop formed rivet head.

FIG. 6*c* illustrates the rivet head 54 as a complete shop fabricated and certified rivet head.

Figure 7:
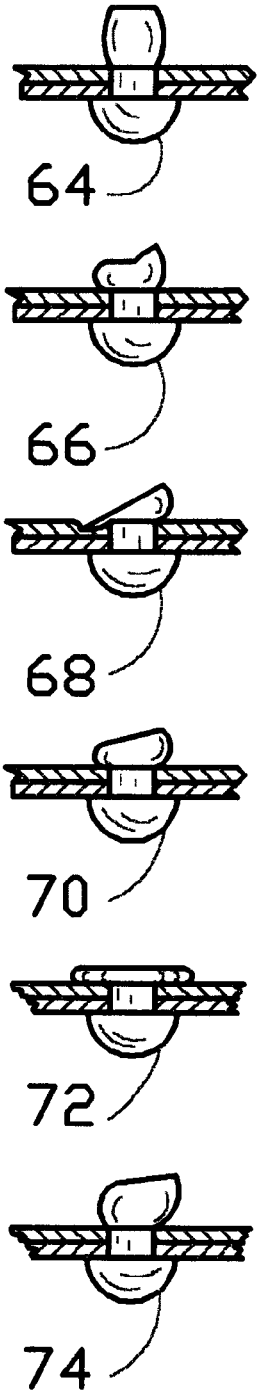
FIG. 7 Prior Art
FIG. 7 Is a perspective view of an assortment of improper and out-of-tolerance shop made rivet heads, shaped by prior art hand held bucking bar anvil.

FIG. 7 provides typical prior art examples of deformed rivet heads that do not meet the manufacturer's specification. Rivet 64 was not completely formed. Rivet 66 shows that the face of the anvil was off center when the riveting operation stopped. Rivet 68 reveals that the bucking bar anvil was held at an angle and too much pressure was used, causing the anvil to cut into the surface of the sheet metal. Rivet 70 shows that the bucking bar anvil was held at the wrong angle. Rivet 72 illustrates how using too much pressure can flatten the rivet's head. Rivet 74 reveals that the bucking bar anvil operator slipped off the top of the rivet shaft, bending the rivet to one side.

Figure 8:
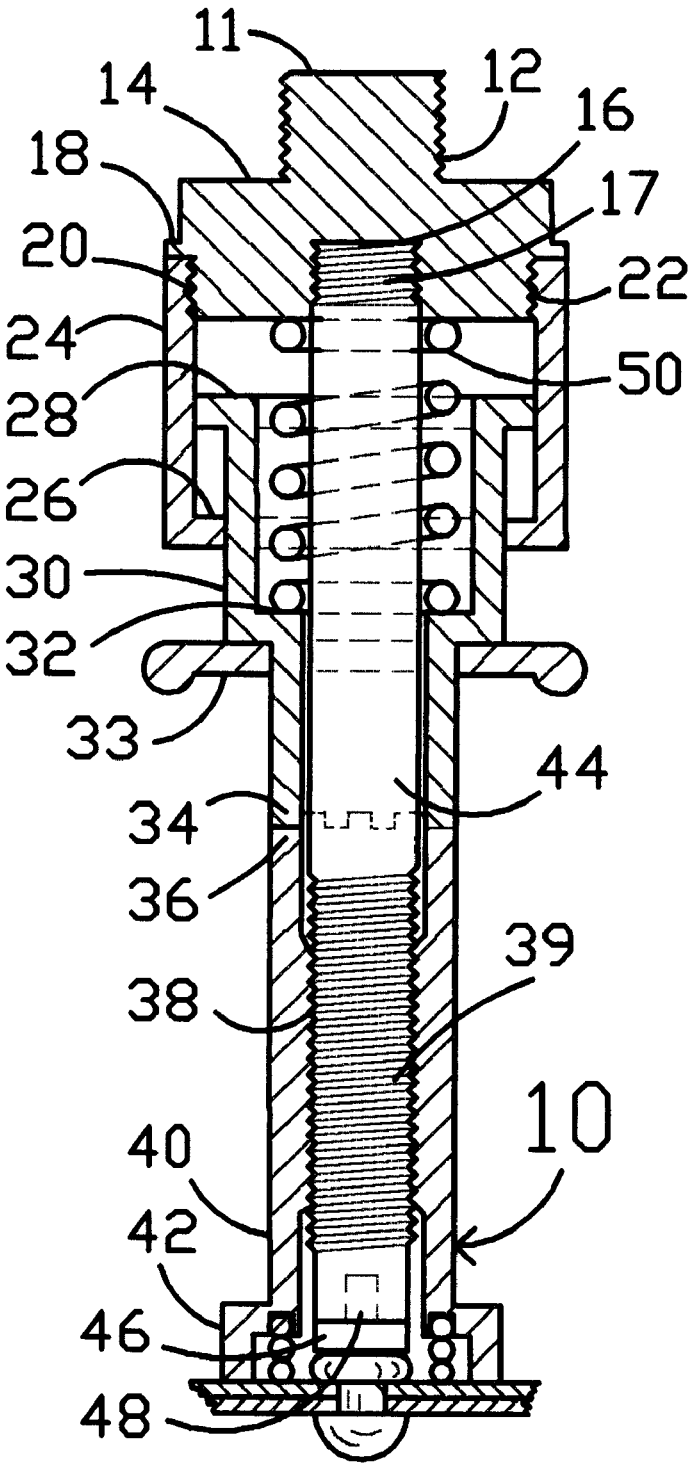
FIG. 8 Is a sectional view showing the assembled hand held micro-adjustable bucking bar.
Figure 8A:
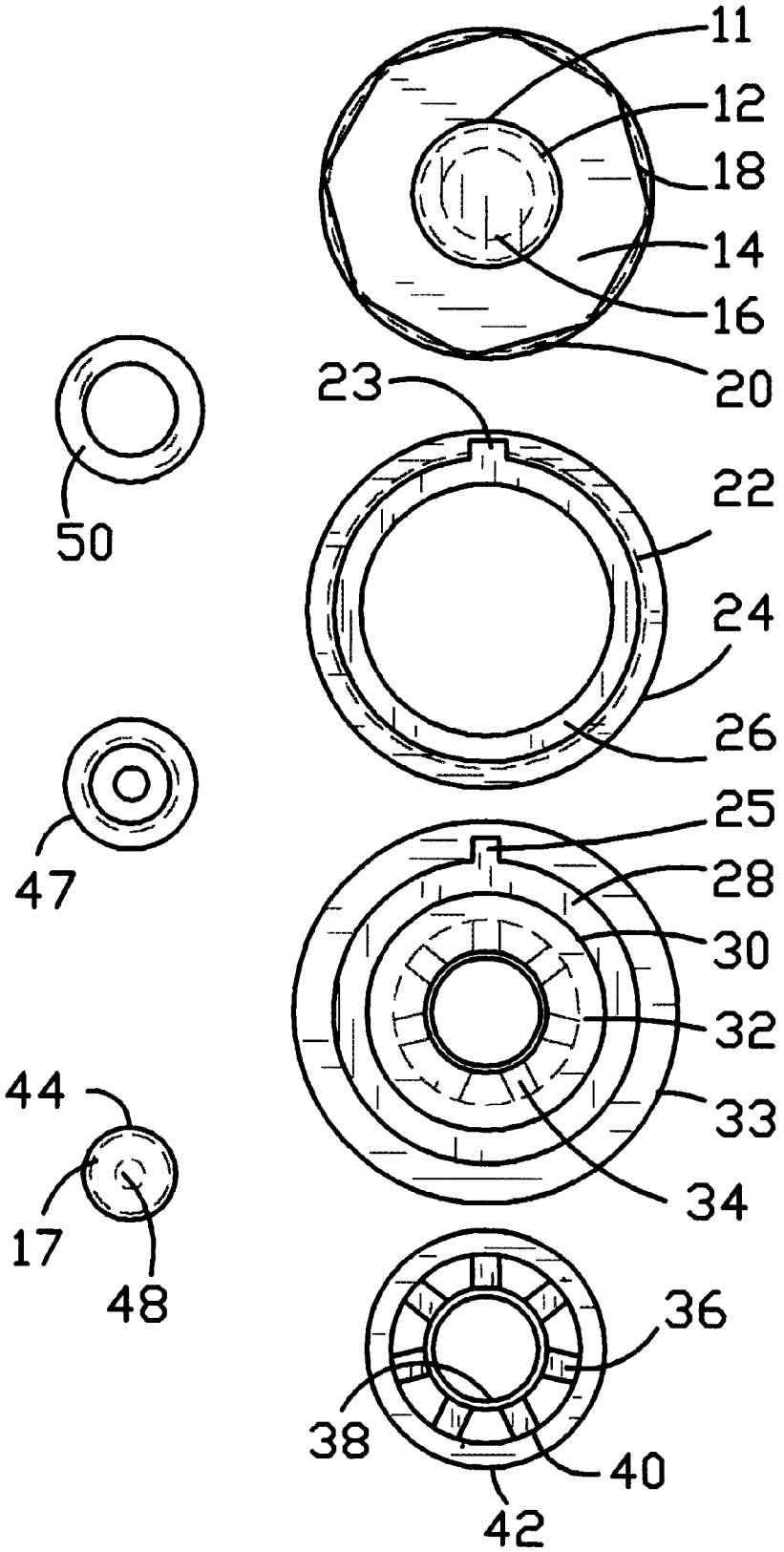
FIG. 8*a* Is a perspective view showing six cutting planes of the hand held micro-adjustable bucking bar anvil.

FIG. 8 best shows a sectional view to reference FIG. 8*a*. FIG. 8*a* shows the end view featuring a round housing 24 having a flute 23 and a flange 26. The flange 26 supports spindle lock flange 28 incorporating a tang 25 that will slide up and down in flute 23 and internally supports the spindle lock 30 and the spindle lock spring 50. Spring 50 presses against spring lock flange 32 and end cap 14. End cap 14 has a wrench flange 18 and external threads 20. External threads 20 will thread into housing threads 22. The anvil bucking bar 44 has a short threaded end 17, a long threaded end 39, an anvil recess 48 to house the anvil tip 46 and the anvil tip 46 supports the alignment guide 47. The anvil bar's 44 short-threaded end 17 will be threaded to the threaded cavity 16 of the end cap 14. The micro-adjustable spindle 40 has internal threads 38 and a castellated lock 36 that will thread onto the bucking bar's internal threads 39 and lock into the micro-adjustable spindle's castellated locks 34 and 36. Installed on the small diameter of the spindle lock 30 is the lock collar 33. The hand held micro-adjustable bucking bar 10 will be installed on to the appropriately weighted handle 90, as seen in FIG. 9, by threading the end cap's external thread 12 into one of the handle's threaded recesses 91.

Figure 9:
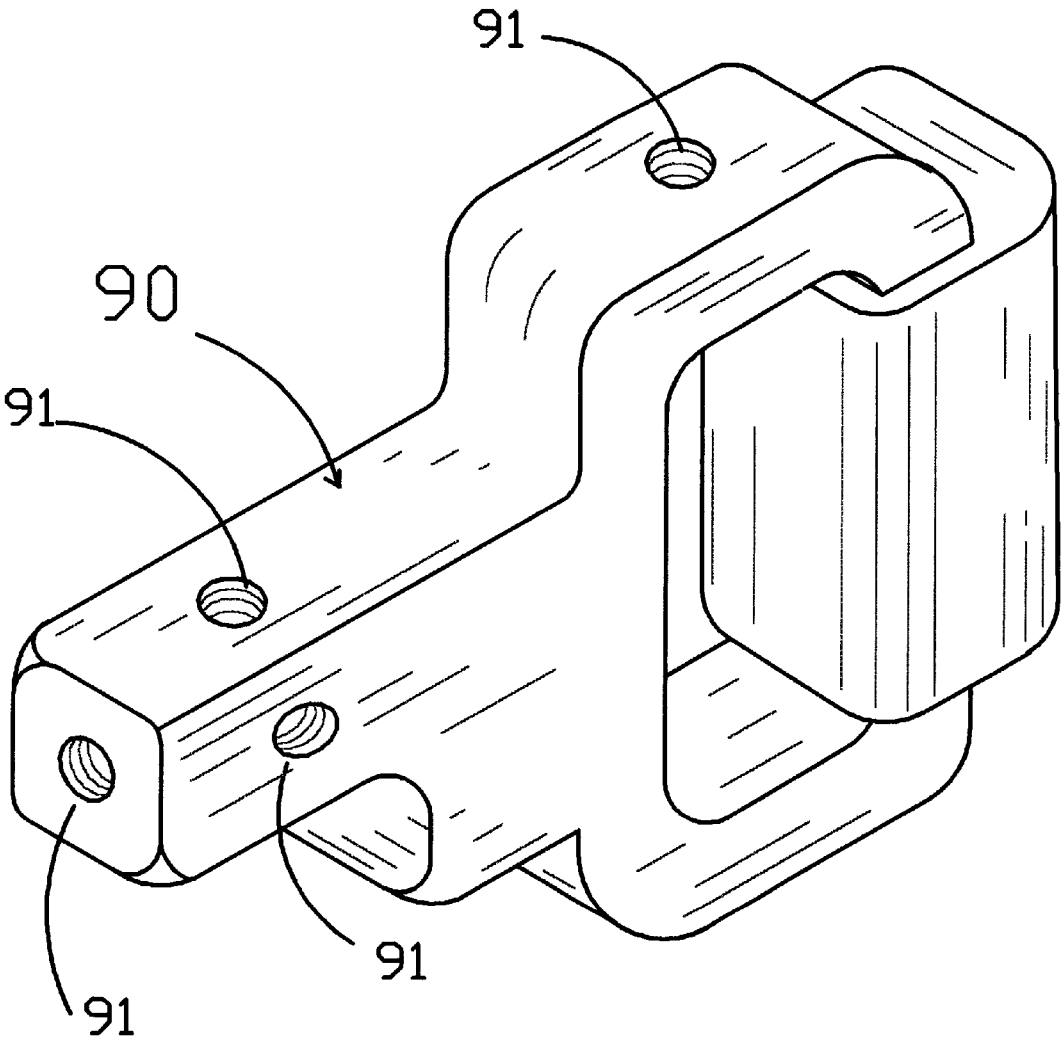
FIG. 9 Is a perspective view of a handle weight for the hand held micro bucking bar anvil.

FIG. 9 shows the handle weight 90 having numerous drilled and internal threaded recesses 91 to accept the micro-adjusted bucking bar's threaded end 11 producing a complete micro-adjustable bucking bar anvil tool.

In operation, the hand held micro-adjustable bucking bar anvil 10 will be adjusted for operation by pushing in on the spindle lock collar 33 toward the cylindrical housing 24 and compressing the spring 50 allowing the spindle castellated locks 34 and 36 to separate, permitting the micro-adjustable spindle 40 to be rotated. By rotating the micro-adjustable spindle 40 clock-wise or counter-clockwise on the bucking bar anvil 44 or more specifically, the bucking bar's threaded area 38 and the spindle's 40 threaded area 39 will increase or decrease the distance of the anvil's tip 46 to the surface of the sheet metal, which the micro-adjustable spindle feet 42 will sit on. Using a standard rivet head template, the operator will adjust the micro-adjustable spindle 40 to set the proper height of the anvil tip 46. The operator will place the anvil tip 46 against the top surface of the standard rivet template's 61 rivet head 60 and by adjusting the micro-adjustable spindle 40 and moving the spindle feet 42 compressing the compression spring 43' down onto the sheet metal's surface 62 will set the height of a newly formed rivet head. At this point the operator will release the spindle lock collar 33 allowing the spring's lock 30(being pushed by the spring 50) to move into the castellated locks 34 and 36 locking the micro-adjustable spindle 40 and anvil tip 46 to the proper height to start making new rivet heads. The spindle lock tang 25 inserted in flute 23 keeps the spindle lock 30 and spindle 40 from rotating clockwise or counter-clockwise, but allows movement of the spindle lock 30 and tang 25 to move along the axis of the flute 23.

Once the setting is completed, the bucking bar operator will make several test samples to certify the newly shaped rivet head 54 settings. At this point the bucking bar operator may start bucking rivets. The micro-adjustable bucking bar spindle 40 will not be required to be readjusted unless the operator starts bucking a different size or diameter rivet. The operator attaches a suitably weighted handle 90 to the end cap's 14 threaded shift 11 and placing the compression spring 43' against a sheet metal's surface and applying a small amount of pressure will squeeze out any air gaps between the overlapping metals sheets. While holding the anvil tip 46 to the flat surface 53 of the rivet shank 54 and simultaneously push the micro-adjustable bucking bar anvil 10 toward the rivet shank 54. As the riveter operates the riveting gun 59 will enlarge and shape the rivet's shank 54 diameter as the micro-adjustable bucking bar's feet 42 move closer to the metal surface 52. As the micro-adjustable bucking bar's feet 42 start to touch the metal sheets 52 will self align the micro-adjustable bucking bar anvil 10 in the horizontal and vertical axis to the work surface. As the micro-adjustable bucking bar's feet 42 are pressed firmly against the metal sheet 52 they will stop the rivet head 54 shaping action, fabricating a shop made rivet head 54 that meets all manufacturing riveting head specifications.

To assemble the hand held micro-adjustable bucking bar anvil 10, a person would thread the bucking bar 44 into the end cap 14 by threading the bucking bar's short threads 17 into the end cap 14 internal threads 16 and installing the bucking bar's 44 long threaded end 39 down through the center of the spring 50 and into the spindle lock 30. To assemble the locking assembly, guide the end cap 14, bucking bar 44, spring 50, and the spindle lock 30 into the cylindrical housing 24 threading the end cap 14 and threads 20 into the cylindrical housing internal threads 22 and rotate the end cap 14 clockwise until the end cap wrench flange 18 is torqued against the cylindrical housing 24.

The first end of spring 50 presses against the end cap 14 and the second end of spring 50 presses against the spindle lock flange 32 forcing the spindle lock 30 away from the end cap 14 and toward the housing flange 26 and stopping when spindle lock flange 28 contacts the cylindrical housing flange 26. The spindle-locking collar 33 is mounted to the spindle-locking flange 32.

Inserting the anvil tip 46 into the anvil cavity 48 and installing the centering alignment guide 47 will allow the installation of the micro-adjustable spindle 40 by rotating the spindle 40 clockwise and engaging the bucking bar threads 39 and spindle threads 38. Compress the spindle collar 33 and spring 50 towards the end cap 14 and continue rotating the spindle 40 clockwise until the spindle 40 is positioned in the adjustment area of the bucking bar 44 or until the micro-adjustable spindle feet 42 are flush with the anvil tip 46. Releasing the spindle lock's collar 33 will lock the spindle castellated locks 34 and 36 into an intermediate position. The spindle compression spring 43' is installed into the spring retaining groove 43 and extended beyond the spindles feet 42 and will make first contact with the surfaces to be riveted together. The hand held micro-adjustable bucking bar 10 of the present invention can be constructed using a metal injection molding process or by drop forging. For added lubrication and to prevent excess wear a TEFLON™ additive of a presently known composition may be used in the molding material of the adjustment spindle 40 and spindle lock 30.

Accordingly, the reader will see the hand held micro-adjustable bucking bar will offer better operating features than the previously described U.S. Patented hand held anvils. It allows the micro-adjustable bucking bar a simpler way of adjusting the spindle, making the micro-adjustable bucking bar an easily adjusting riveting anvil for inexperienced or experienced riveters. It permits precision shaping of rivet shanks into shop formed rivet heads. It provides a micro-adjustable locking means. It allows the anvil tip to be removed and replaced. It provides a micro-adjustable spindle with an assortment of small, large, triangle, round, half-round, oval, and rectangular feet. It provides a novel and inconspicuous way of setting the height requirements of the anvil tip to shape the shop rivet heads while providing a compression spring to compress the sheet metals together, eliminating any air gaps.

The foregoing description is intended primarily for purposes of illustration. This invention may be embodied in other forms or carried out in other ways without departing from the spirit or scope of the invention. Modifications and variations still falling within the spirit of the scope of the invention will be readily apparent to those skilled in the art.

What I claim is:

1. A bucking bar for supporting and backing while forming a rivet head on a shank passing through stock opposite a manufactured head engaged by a rivet gun comprising:

a. An elongated cylindrical housing having an internal support means, b. a hollow cylindrical internal sleeve; with a larger cylindrical housing on one end and a smaller cylindrical housing on the second end, c. a metal end cap member with internal thread centrally located on one side of the large diameter end, and external thread installed on a stud on the opposite side of the large diameter end, with at least two parallel surfaces on the diameter, d. an elongated solid shank having a male thread on one end, a set of centrally located external threads and a receptacle on the second end, e. a hollow cylindrical spindle having a locking means on the surface of one end, an internal thread centrally located and a cylindrical base flange on the second end, f. a coral spring of sufficient size received in said elongated cylindrical housing g. a spring of sufficient size with flat surfaces at each end, whereby received in said cylindrical base flange and h. a Palmer grommet centrally located with a sufficient size countersunk and through hole.

2. The bucking bar as defined in claim 1, further including at least one longitudinal flute inside the said elongated cylindrical housing, said housing having an internal thread on one end and an internal flange on the second end.

3. The bucking bar as defined in claim 1, further including an external flange with a tab locking means, an internal flange of a said smaller cylindrical housing than the said external flange and a locking means on the second end surface of said sleeve.

4. The bucking bar as defined in claim 1, further including said end cap supporting said elongated solid shank installed in said internal thread centrally located in large diameter end.

5. The bucking bar as defined in claim 1, further including an externally exposed impact receiving surface of sufficient diameter.

6. The bucking bar as defined in claim 1, further including an attached collar on the smaller diameter of the said cylindrical internal sleeve.

7. The bucking bar as defined in claim 1, further including a coral spring within said housing whereby urging said sleeve and said end cap to separate from each other.

8. A tool for supporting and backing while forming a rivet head on a shank passing through stock opposite a manufactured head engaged by a rivet gun comprising:

a. A lengthened cylindrical structure having an internal support means, b. a hollow cylindrical internal telescoping sleeve; with a larger cylindrical housing on one end and a smaller cylindrical housing on the second end, c. an alloy end cap member with internal thread centrally located in large diameter end, external thread installed on stud and large diameter end and at least two parallel flat surfaces on the large diameter, d. an extended solid shank having a male thread on one end, a set of centrally located external threads and a receptacle on the second end, e. a hollow cylindrical spindle having a locking means on the surface of one end, an internal thread centrally located and a cylindrical foundation flange on the second end, f. a coral spring of satisfactory size received in said elongated cylindrical housing, g. a spring of sufficient size with even surfaces at each end, whereby received in said cylindrical base flange and h. a Palmer grommet centrally located with a sufficient size countersunk and through opening.

9. The bucking bar as defined in claim 8, further including at least one longitudinal flute inside the said lengthened cylindrical structure, said housing having an internal thread on one end and a internal flange on the second end.

10. The bucking bar as defined in claim 8, further including an external flange with a tab locking means, an internal flange of a said smaller cylindrical housing than the said external flange and a locking means on the second end surface of said sleeve.

11. The bucking bar as defined in claim 8, further including said end cap supporting said extended solid shank installed in said internal thread centrally located in large diameter end.

12. The bucking bar as defined in claim 8, further including an externally exposed impact-receiving surface of sufficient diameter.

13. The bucking bar as defined in claim 8, furthers including an attached collar on the smaller diameter of the said cylindrical internal telescoping sleeve.

14. The bucking bar as defined in claim 8, further including a coral spring within said structure whereby urging said sleeve and said end cap to separate from each other.

* * * * *